United States Patent [19]

Babayan

[11] 4,095,404

[45] Jun. 20, 1978

[54] METHOD OF MANUFACTURING A HIGH-STRENGTH, POLYURETHANE-IMPREGNATED POLYAMIDE CABLE

[75] Inventor: Eduard P. Babayan, Huntington Beach, Calif.

[73] Assignee: Hitco, Irvine, Calif.

[21] Appl. No.: 790,546

[22] Filed: Apr. 25, 1977

Related U.S. Application Data

[62] Division of Ser. No. 621,005, Oct. 9, 1975, Pat. No. 4,034,138, which is a division of Ser. No. 429,220, Dec. 28, 1973, abandoned.

[51] Int. Cl.[2] ..... D02G 3/40

[52] U.S. Cl. ..... 57/164; 57/157 TS

[58] Field of Search ..... 57/157 TS, 157 MS, 164; 427/175; 156/148, 180

[56] References Cited

U.S. PATENT DOCUMENTS

| | | | |
|---|---|---|---|
| 2,775,860 | 1/1957 | Morrison | 156/180 X |
| 3,021,290 | 2/1962 | Gmitter et al. | 260/2.5 AK |
| 3,309,861 | 3/1967 | Pierson et al. | 57/140 C |
| 3,395,529 | 8/1968 | Ray | 427/175 X |
| 3,538,700 | 11/1970 | Hofer | 57/139 |
| 3,549,569 | 12/1970 | Farah et al. | 260/18 TN |
| 3,609,112 | 9/1971 | Schroeder et al. | 260/77.5 AM |
| 3,619,317 | 11/1971 | Shulver et al. | 156/180 |
| 3,748,291 | 7/1973 | Bhakuni et al. | 57/153 |
| 3,804,812 | 4/1974 | Koroseil | 260/77.5 AM |
| 3,960,050 | 6/1976 | Eisler | 427/175 X |

OTHER PUBLICATIONS

Saunders, et al., *Polyurethanes,* Part II, Interscience, New York, 1964, p. 532.

*Primary Examiner*—Ronald H. Smith
*Assistant Examiner*—Evan K. Lawrence
*Attorney, Agent, or Firm*—Marvin E. Jacobs

[57] ABSTRACT

A high-strength, low weight, electromechanical cable is manufactured from aromatic polyamide multifilament yarns impregnated with a hydrolytically stable polyurethane resin to form a protective coating. The coating provides load adjustment from fiber to fiber, eliminates abrasive self-destruction of the fibers during flexing of the yarn under load, protects the fiber to some extent from ultraviolet radiation, aggressive chemicals or abrasive particles and makes it possible to preform the yarn. The coating comprises a reaction product of a liquid tetramethylene glycol, an aliphatic/cycloaliphatic diisocyanate and a diamine coupling-curing agent. The impregnated yarns are dried, twisted together, heated above the softening point of the resin to fuse the coatings of adjacent yarns, and then cooled to form a set twisted helix of the yarns.

9 Claims, 3 Drawing Figures

METHOD OF MANUFACTURING A HIGH-STRENGTH, POLYURETHANE-IMPREGNATED POLYAMIDE CABLE

This is a division of application Ser. No. 621,005, filed Oct. 9, 1975, now U.S. Pat. No. 4,034,183, which in turn is a division of application Ser. No. 429,220 filed Dec. 28, 1973, now abandoned.

BACKGROUND OF THE INVENTION

1. Field of the Invention

The present invention relates to coated fibers and cables prepared therefrom and, more particularly, to hydrolytically stable, thermoplastic, polyurethane-coated, multifilament strength members for said cables.

2. Description of the Prior Art

Quite often in power and communication cables, the electrical conductor also serves as the strength member, providing the necessary mechanical support as well as the electrical transmission path. For many applications, however, the electrical conductor cannot provide the necessary mechanical strength and protection that are required, and must be joined together with separate strength members. Such cables, which obviously have a significant percentage of their volume composed of strength members, are normally referred to as electromechanical cables which are externally armored to provide both strength to support the weight of the cable and mechanical protection against abrasion and cutting.

Typical oceanographic missions for electromechanical cables include the launch, recovery and control of tethered vehicles, the power and control for mining or bottom sampling equipment, towed instrumentation sleds or bottom-mounted static arrays. The electrical portion of these cables is used to transmit communication signals, control signals, and sensor data, and for power transmission to equipment installed on the ocean floor or suspended in the water column.

The analysis and design of the mechanical portion of the cable, and its influence on the electrical properties, is a well developed science. For cables deployed from a ship, an accurate prediction of motions and loads is difficult, if not impossible. Since mechanical failure will generally mean the loss of expensive equipment and potential injury to personnel, cable designers are forced to be extremely conservative. This, coupled with the fact that until recently steel was the only choice available as a reliable strength member material, meant that long cables would have high self-weight. From a systems viewpoint, this relfected a decrease in convenience and ease of operations, and a definite increase in the size and cost of associated handling gear.

Bending fatigue, from repeated flexing of cables under load over a sheave, is another mechanical problem of great concern to the designer. High-strength steel has relatively poor flexure fatigue resistance, but other materials have not been available as an alternative. As longer cables are required for deeper application, the high self-weight of the strength members produces an uncomfortably low static factor of safety, aggravating the already serious fatigue problem. The use of lightweight synthetic strength members has generally not been acceptable, due to their low elastic modulus which is not compatible with the low allowable stretch of electrical conductors incorporated in the cable.

Steel and titanium were generally unacceptable because of their low strength-to-weight ratios and poor fatigue properties under flexure. Boron and graphite appeared attractive initially, because of their high strength-to-weight ratios and high modulus, but poor abrasion resistance and extremely high cost eliminated them as practical solutions. Fiberglass had been used successfully in other lightweight marine cable applications but suffered from abrasion problems as well as a susceptibility to static tensile fatigue.

Recently a new, synthetic, organic, high modulus material has become available having a higher modulus than fiberglass, lower density, better abrasion resistance, equal or better strength and better static tensile fatique properties. A protective coating is necessary:

(1) to isolate the fibers and protect them from destructive self abrasion;

(2) provide load adjustment from fiber to fiber or to provide load normalizing when the fiber bundle or yarn is loaded in tension;

(3) to protect the fibers from hostile environments of harmful chemicals such as strong acids, ultraviolet radiation or abrasive particles such as sand; and (4) to make it possible to form or preform the coated yarn or fiber bundle so that it will retain all or part of the shape change imposed on the coated yarn. This characteristic is important to making rope and other load carrying line products.

Attempts to impregnate the fibers with epoxy or urethane resins were unsuccessful. Epoxy resins must have a 25% matrix for maximum load capability and 35–40% for peak load strength. Even utilizing silicone as a lubricant for inter-fiber slippage as the cable is flexed, the rigid epoxy coating prevented fiber movement. The hydrolytic stability of epoxies in sea water is questionable. When it was attempted to impregnate the fibers with a polyurethane (Estane 53800), the results were again unfavorable due to poor fiber wetting and incomplete penetration of the fiber bundles

SUMMARY OF THE INVENTION

The invention is directed to a method of manufacturing a high-strength polyamide cable from aromatic polyamide multi filament yarns impregnated with a hydrolytically stable polyurethane resin. The coated yarn fibers show higher tensile loading than the uncoated fibers, are not subject to self-destructive abrasive action, can be formed or preformed in desired shape and are protected from adverse environments. The urethane resin lacquer solution readily wets the fibers and efficiently and effectively impregnates fiber bundles. The polyurethane resin of the invention has a poor memory and the properties can be readily adjusted by varying the proportion of ingredients within set limits.

The urethane lacquer of the invention is a solution of the reaction product of a liquid polytetramethylene glycol and an aliphatic/cycloaliphatic isocyanate with a cycloaliphatic diamine. The polyurethane as a film has a tensile strength from 5,000 to 6,000 psi and an elongation of 400–500%.

The high modulus fibers are impregnated to a level of from 5–95% by weight with the polyurethane resin, preferably from 15–40%, dried, formed as by twisting and then heated to the fusion temperature of the resin. Since the modulus of the fiber is high relative to the polyurethane sizing, the coated fibers slide relative to one another without abrading. The bundle of fibers may include a central conductor. Since the coated fibers have good dielectric properties, conductor wires may be incorporated into the twisted multifilament cable.

These and many other objects and attendant advantages of the invention will become apparent as the invention becomes better understood by reference to the following detailed description when considered in conjunction with the accompanying drawings.

DESCRIPTION OF THE PREFERRED EMBODIMENTS

The high modulus fibers are a synthetic, organic polymer having very high tensile strength and resistance to stretch and having light weight, good toughness and environmental stability. The density of the fibers is less than 1.5 gm/cc, the tensile strength at least 300,000 and modulus of at least $10^6$ psi, 480 gpd. The specific tensile strength (yarn tensile strength/density) is at least $10^6$ in. and the specific modulus is at least $10^8$ in.

The preferred material is a continuous yarn known as PRD-49 or Kevlar 49 (Dupont) which is an aromatic polyamide. The material is supplied as a multifilament yarn in deniers (weight in grams per 1000 meters) of 190, 380 and 1420. Each monofilament is continuous, is circular in cross section with a diameter of 0.00046 inch and a denier value of 1.42. Properties of Kevlar 49 are presented in the following table.

Table 1

| | | |
|---|---|---|
| Density | 1.45 g/cc | 40% lower than glass and boron, and slightly lower than graphite. |
| Tensile Strength | 400,000 psi | Substantially above conventional organic fibers and equivalent to most high performance reinforcing fibers. |
| Specific Tensile | $8 \times 10^6$ in. | Highest of any commercially available reinforcing fiber. |
| Modulus | $19 \times 10^6$ psi | Twice that of glass fibers. |
| Specific Modulus | $3.5 \times 10^8$ in. | Between that of the high modulus graphites and boron and that of glass fibers. |
| Chemical Resistance | Good | Highly resistant to organic solvents, fuels, and lubricants. |
| Flammability Characteristics | Excellent | Inherently flame resistant. Self-extinguishing when flame source is removed. Does not melt. |
| Temperature Resistance | Excellent | No degradation of yarn properties in short term exposures up to temperatures of 500° F. |

The material is available as 380 denier yarn and 1420 yarn. Coated fiber composite strength members in accordance with the invention exhibit the following characteristics.

Table 2

| | |
|---|---|
| Composite Tensile Strength | ≧250,000 psi |
| Composite Elastic Modulus | ≧12,000,000 psi |
| Composite Specific Gravity | ≦1.35 |
| Flexure Life | Excellent |
| Effects of Pressurization in seawater | Negligible to at least 10,000 psi |
| Elongation at Break | 2.2% |

Figure 1:
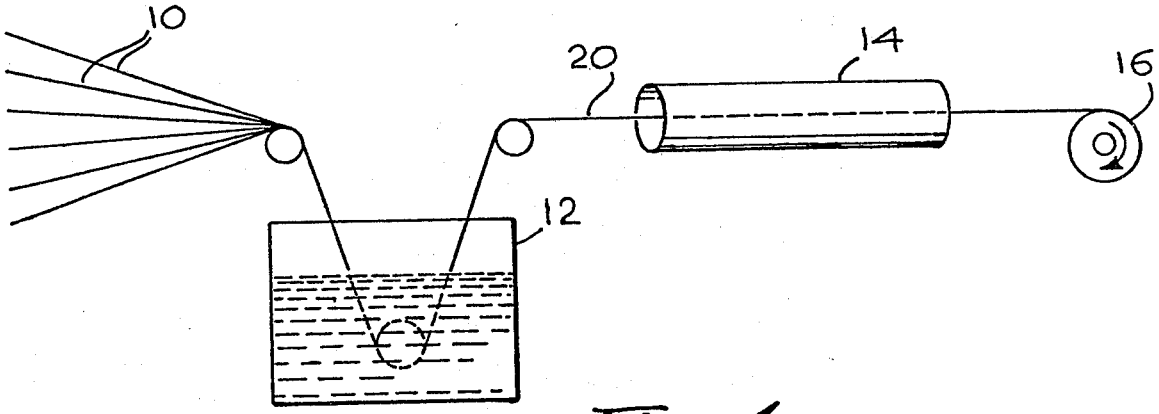
FIG. 1 is a schematic diagram of the impregnation stage of the process.
Figure 2:
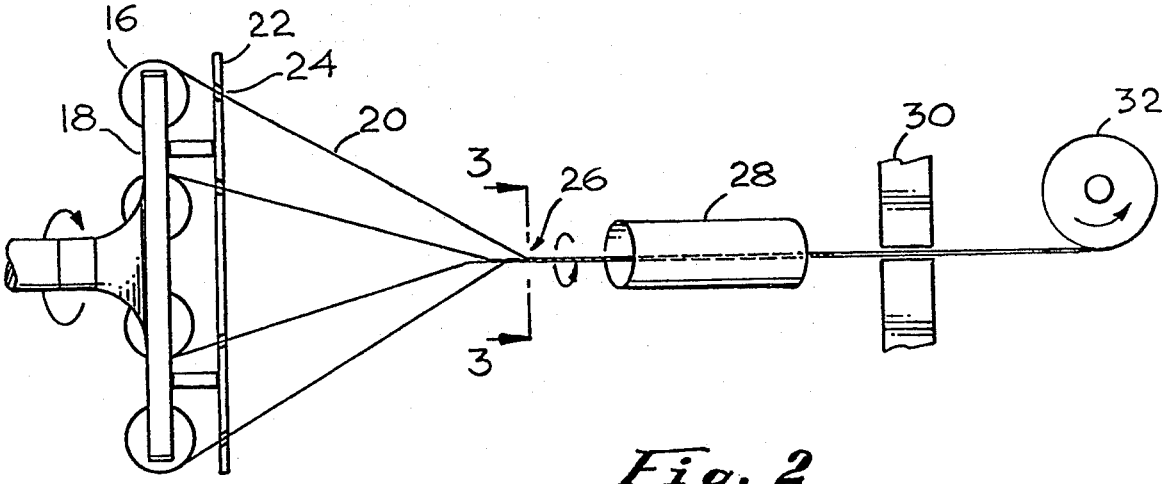
FIG. 2 is a schematic view of the composite formation stage of the process.
Figure 3:
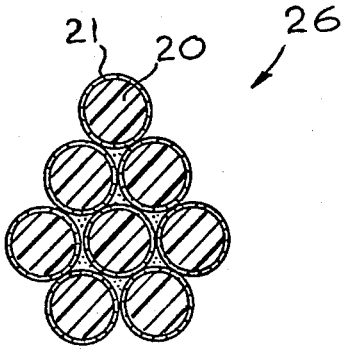
FIG. 3 is a cross-sectional view taken along the line 3—3 of FIG. 2.

A fabrication technique is schematically shown in FIGS. 1 and 2. The individual yarns 10 are precoated with resin in bath 12 and dried in oven 14 at a temperature from 150° to 200° F. The precoated yarns 20 with coating 21 thereon are then wound on spools 16 mounted in a rotatable frame 18. The coated yarns are passed through a template 22 which rotates with the frame. A series of concentric holes 24 are drilled in the template (the same 1, 6, 12, 18, . . . 6(N-1) pattern used in winding stranded ropes, and each yarn 20 is passed through its own individual hole. The yarns are pretensioned and then twisted together in a conveying helix 26 as they pass through a preheater 28 at a temperature of 200°–300° F (to soften the resin matrix to a nearly fluid state), pulled through a heated sizing die 30 at a temperature of about 170° to 220° F, and cooled to room temperature before being wound on a storage reel 32.

The result is a tightly twisted helix 26 of filaments 20 which retain an infinitesimal coating 21 of resin for lubrication and structural bonding. The helix angle (lay length) is controlled by fixing the ratio of turns per unit of advance of the precoated yarns. Diameter of the strength member becomes primarily a function of the number of filaments, and is only weakly sensitive to lay length, yarn tension- initial resin fraction or die temperature. The sizing die acts primarily to control circularity and to wipe away excess resin.

The simultaneous twisting/heating process also reduces void content to a neglible fraction ($<< 1\%$) by wringing trapped air and solvent vapor out of the filament helix. Those minute voids which remain are confined to a thin annulus of resin between the filaments and the outer surface, and do not degrade the properties of the member. Packing fractions for the filaments in the composite member have been running between 66 and 69%.

The polyurethane lacquer is impregnated onto the fibers in an amount of from 5 to 95% by weight, suitably from 5 to 40%. Optimum physical properties are provided in the range of 20–35% by weight. The polyurethane in accordance with the invention is the reaction product of a stoichiometric mixture of an aliphatic/cycloaliphatic diisocyanate with a liquid polytetramethylene glycol which is further cured with an aliphatic diamine coupling-curing agent. The final polyurethane is a soluble thermoplastic capable of solution coating of the fibers and capable of heating to fusion after application.

The polytetramethylene ether glycol has a molecular weight from 500 to 3,000 and is suitably a Polymeg 650, 1,000 or 2,000. The aliphatic diisocyanate can be a straight chain aliphatic such as hexamethylene diisocyanate, a cycloaliphatic such as $H_{12}$ which is 4,4'-methylene bis (cyclohexyl isocyanate) or preferably a mixed aliphatic-cycloaliphatic such as compounds of the formula:

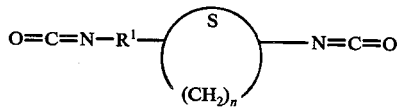

where $R^1$ is alkylene of 1–10 carbon atoms and $n$ is an integer from 4 to 10.

The preferred diisocyanate is an alkylated, isocyantoalkyl cyclohexyl isocyanate of the formula

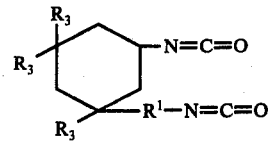

where $R_3$ is lower alkyl. When all the $R_3$ are methyl and $R^1$ is menthylene, the compound is isophorone diisocyanate (IPDI).

The coupling-curing agent is an aliphatic, preferably cycloaliphatic, diamine such as isophorone diamine (IPD) or methane diamine.

The composition also contains minor amounts of other additives such as 0.1 to 0.5 phr of a curing catalyst such as dibutyl tin dilaurate, 1–5 phr of a drying agent such as a molecular sieve. Colloidal or amphoteric silicate fillers can be added in an amount from 1–10 phr to increase the strength of the coating. Minor amounts of other additives such as ultraviolet absorber, antioxidants or dyes and pigment can be added if desired.

The reactive ingredients are combined in a solvent system which is a solvent for the ingredients and for the polymer. Preferably, the Polymeg, molecular sieve, catalyst and IPDI are first reacted in xylene to form a prepolymer. The diamine dissolved in part of a mixture of isopropanol and methyl ethyl ketone (MEK) is slowly added to the prepolymer until the pH is from 7–8. Isopropanol provides a retardant effect avoiding gelling and xylene and MEK contribute to chain build of the polyurethane.

A preferred formulation for the polyurethane lacquer is provided in the following table.

Table 3

| Ingredient | Range, pbw | Example 1, pbw |
|---|---|---|
| PART A | | |
| Polymeg 650 | 100 | |
| Molecular Sieve | 1–5 | 2 |
| Dibutyl tin dilaurate | 0.1–0.5 | 0.2 |
| Xylene | 50–150 | 92 |
| IPDI | Stoichiometric | 69.3 |
| PART B | | |
| Isopropanol | 150–400 | 244 |
| IPD | Stoichiometric | 26.9 |
| MEK | 150–400 | 237 |

Part A is mixed and prereacted to form a prepolymer. Part of the isopropanol and MEK are added to Part A and the IPD is dissolved in the remaining solvent and slowly added until the pH is 7–8. If the final pH is above this range, the composition turns yellow on aging and the properties degrade. The lacquer is stable and does not contain any reactive isocyanate groups. Test specimens were cast and the solvent evaporated. The films exhibited a tensile strength of 5,000 to 6,000 and an elongation from 400–500:

EXAMPLE 2

When an equivalent amount of Polymeg 1000 was substituted for the Polymeg 650, the film had a tensile strength of 2,000–3,000 and an elongation of 500–600%.

EXAMPLE 3

When an equivalent amount of Polymeg 2000 was substituted for the Polymeg 650, the film had a tensile strength of 1,000–2,000 and an elongation of >750%.

The polyurethanes of the invention exhibit excellent hydrolytic stability. The hydrolytic stability of polyurethanes prepared from polyester polyols or ethylene oxide or propylene oxide polyethers is unsatisfactory. The elongation of polyurethanes prepared from high vinyl polybutadiene diols is too low, and the tensile strength of polyurethanes prepared from high 1,4-content polybutadienes is too low. Similarly, menthane diamine and HMDI or $H_{12}$MDI provide lower strength polyurethanes than IPD or IPDI.

The polyurethane lacquer of this invention has excellent wetting characteristics and viscosity. The finally cured polyurethane coating has excellent bond shear strength, elasticity and can be repeatedly heat-softened during serial fabrication processes. The coatings of the individual multifilaments bond together to form a matrix for the twisted multifilaments.

Strength members for cables were prepared from 380 denier PRD-49 impregnated with the polyurethane lacquer of Example 1 according to the procedure of FIGS. 1 and 2.

The results of tensile strength and elastic modulus measurements are shown in the proof run column of Table 4.

Table 4

| Parameter | Proof Run | Production Runs for Prototype Cables 1 | 2 | 3 | 4 |
|---|---|---|---|---|---|
| Strength Member Diameter (inches) | 0.073 | 0.073 | 0.073 | 0.097 | 0.097 |
| Strength Member Specific Gravity | 1.34 | 1.34 | 1.34 | 1.34 | 1.34 |
| Denier Value of PRD-49-III Yarns | 380 | 380 | 380 | 380 | 380 |
| Yarns Per Strength Member | 65 | 65 | 65 | 110 | 110 |
| PRD-49-III Filaments Per Strength Member | 17,355 | 17,355 | 17,355 | 29,370 | 29,370 |
| Strength Member Lay Length (inches) | 1.0 | 1.0 | 1.0 | 1.0 | 1.0 |
| Filament Packing Fraction | 0.689 | 0.689 | 0.689 | 0.661 | 0.661 |
| Composite Tensile Strength | | | | | |
| Number of Samples Tested | 10 | 10 | 44 | 11 | 28 |
| Mean Value of Tensile Strength ($10^3$ psi) | 260.7 | 237.9 | 250.4 | 235.3 | 260.5 |
| Standard Deviation | 7.46 | 12.15 | 15.81 | 7.21 | 11.18 |
| Coefficient of Variation (%) | 2.86 | 5.11 | 6.31 | 3.06 | 4.29 |
| Composite Elastic Modulus | | | | | |
| Number of Samples Tested | 19 | 10 | 44 | 11 | 28 |
| Mean Value of Elastic Modulus ($10^6$ psi) | 12.55 | 12.10 | 11.90 | 12.40 | 12.15 |
| Standard Deviation ($10^6$ psi) | 0.27 | 0.33 | 0.30 | 0.44 | 0.32 |
| Coefficient of Variation (%) | 2.15 | 2.70 | 2.52 | 3.59 | 2.67 |
| Mean Filament Tensile Strength ($10^3$ psi) | 378.4 | 345.3 | 363.4 | 356.0 | 394.1 |
| Mean Filament Elastic Modulus ($10^6$ psi) | 18.21 | 17.56 | 17.27 | 18.76 | 18.38 |

The composite members exhibit excellent tensile strength and very low specific gravity, the significance being most apparent when the properties of the strength members are compared to commercial cabling steels and other possible strength member materials as shown in Table 5.

Table 5

| | Tensile Strength ($10^3$ psi) | Specific Gravity | Elastic Modulus ($10^6$ psi) | Strength/Density Ratio ($10^3$ feet) In Air | Strength/Density Ratio ($10^3$ feet) In Seawater*** |
|---|---|---|---|---|---|
| PRD-49-III* | 260 | 1.34 | 12.7 | 448.0 | 2000.0 |
| S-Glass* | 340 | 2.08 | 8.1 | 377.0 | 754.0 |
| Graphite* | 187 | 1.49 | 21.0 | 290.0 | 960.0 |
| Steel | 225 | 7.80 | 30.0 | 66.5 | 76.8 |
| Titanium | 113 | 4.42 | 16.2 | 58.7 | 76.7 |

*Figures are for material in a useful composite form.
***For mean ocean depth of 10,000 feet.

For each material shown in Table 5, entries in the last two columns are numerically equal to the "free length" of the material, that is, to the suspended length at which the strength member will break of its own weight. For PRD-49 composite strength member, this length is 6.7 times greater than for steel in air, and 26 times greater in seawater.

A number of additional measurements have been made on PRD-49 strength members. Several strength members were subjected to pressurization in seawater. Samples were either cycled (16 times) to 10,000 psi, or were soaked for 24 hours at that pressure. Within an experimental error of 0.5%, no water absorption was observed. The only visual change was a collapsing of the annular voids noted above, and the members continued to feel smooth to the touch. Changes in tensile strength and elastic modulus were statistically insignificant. Several PRD-49 strength members were flexure-cycled over a steel sheave, at a diameter ratio of 38/1, while loaded to 50% of measured breaking strength. The amplitude of the flexure angle was ±28°. All samples survived the test, displaying flexure lifetimes of more than 110,000 cycles. The only observable change in the members was an approximate 15% loss of cross sectional area at the contact point, where the member fretted along the axis of the sheave.

Although only preliminary tests have been run to date, PRD-49 strength members appear to exhibit minimal creep under load. Members loaded to 50% of breaking strength appear to stabilize after a few hours and, in the period between 24 and 72 hours of continuing load, show negligible creep. Under short-term loading, the members fail at an elongation of 1.8 to 2.0%.

It is to be realized that only preferred embodiments of the invention have been described, and that numerous substitutions, alterations and modifications are all permissible without departing from the spirit and scope of the invention as defined in the following claims.

What is claimed is:

1. A method of manufacturing a high-strength, lightweight cable comprising the steps of:

impregnating high modulus, multifilament, aromatic polyamide yarns with a solution of thermoplastic resin to a level of 15 to 40% by weight of resin, said resin being a hydrolytically stable, solvent soluble polyurethane comprising the stoichiometric reaction product of:

a liquid polytetramethylene glycol having a molecular weight from 500 to 3,000;

an aliphatic-cycloaliphatic diisocyanate of the formula:

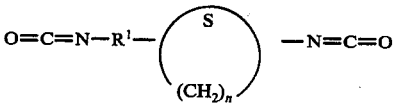

where $R^1$ is alkylene of 1–10 carbon atoms and $n$ is an integer from 4 to 10;

a cycloaliphatic diamine coupling-curing agent;

drying said impregnated yarns to form a resin coating thereon;

twisting a plurality of individual dried yarns into a continuous helix assembly;

heating the twisted yarn assembly to a temperature above the softening point of the resin to fuse the coatings of adjacent yarns; and cooling the heated assembly to form a set twisted helix of said yarns.

2. A method according to claim 1 further including the step of passing said heated, twisted yarns through a heated, circular, sizing die before cooling to remove excess resin and to conform the outside circularity of the assembly.

3. A method according to claim 1 in which the yarns are placed in tension during twisting.

4. A method according to claim 1 in which the diamine is isophorone diamine.

5. A method according to claim 1 in which the resin further includes 0.1 to 0.5 phr of a curing catalyst, 1–5 phr of a drying agent, and 1–10 phr of silicate fillers.

6. A method according to claim 1 in which the resin is dissolved in a mixture of an aromatic, ketone and alkanol solvent.

7. A method according to claim 6 in which the solvent mixture comprises xylene, methyl ethyl ketone and isopropanol.

8. A method according to claim 1 in which the diisocyanate is a compound of the formula:

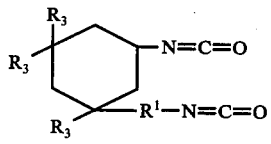

where $R^3$ is lower alkyl and $R^1$ is alkylene of 1–10 carbon atoms.

9. A method according to claim 8 in which $R^3$ is methyl and $R^1$ is methylene.

* * * * *